US008256988B1

(12) United States Patent
Haber

(10) Patent No.: US 8,256,988 B1
(45) Date of Patent: Sep. 4, 2012

(54) HURRICANE TAMING APPARATUS AND METHOD OF USE

(76) Inventor: Jose Cherem Haber, Mexico City (MX)

( * ) Notice: Subject to any disclaimer, the term of this patent is extended or adjusted under 35 U.S.C. 154(b) by 1201 days.

(21) Appl. No.: 11/077,601

(22) Filed: Mar. 10, 2005

(51) Int. Cl.
*E02B 3/06* (2006.01)

(52) U.S. Cl. ..... 405/29; 405/27

(58) Field of Classification Search ..... 405/15, 405/21, 23–29
See application file for complete search history.

(56) References Cited

U.S. PATENT DOCUMENTS

| | | | | | |
|---|---|---|---|---|---|
| 310,551 | A * | 1/1885 | Averell | 405/26 |
| 2,388,171 | A * | 10/1945 | McVitty | 405/224 |
| 3,355,894 | A * | 12/1967 | Vidal | 405/33 |
| 3,846,990 | A * | 11/1974 | Bowley | 405/26 |
| 4,027,486 | A * | 6/1977 | Dougherty | 405/27 |
| 4,074,497 | A * | 2/1978 | Ono | 405/195.1 |
| 4,130,994 | A * | 12/1978 | Van Moss, Jr. | 405/24 |
| 4,174,185 | A * | 11/1979 | Toki | 405/27 |
| 4,175,887 | A * | 11/1979 | Mougin | 405/25 |
| 4,227,829 | A * | 10/1980 | Landry, Jr. | 405/20 |
| 4,341,489 | A * | 7/1982 | Karnas | 405/35 |
| 4,850,190 | A * | 7/1989 | Pitts | 60/398 |
| 5,108,222 | A * | 4/1992 | Jansson et al. | 405/20 |
| 5,380,124 | A * | 1/1995 | Cacossa et al. | 405/16 |
| 5,622,449 | A * | 4/1997 | Essay, Jr. | 405/19 |
| 5,879,105 | A * | 3/1999 | Bishop et al. | 405/26 |
| 5,971,658 | A * | 10/1999 | Pramono et al. | 405/21 |
| 6,416,253 | B1 * | 7/2002 | Wimp et al. | 405/172 |
| 6,669,403 | B2 * | 12/2003 | Clark et al. | 405/30 |
| 2002/0114669 | A1 * | 8/2002 | Yang | 405/29 |
| 2002/0132539 | A1 * | 9/2002 | Smith | 441/133 |
| 2003/0022134 | A1 * | 1/2003 | Seniuk | 433/229 |
| 2003/0072615 | A1 * | 4/2003 | Woodall et al. | 405/25 |
| 2003/0190191 | A1 * | 10/2003 | Clark | 405/26 |
| 2004/0011881 | A1 * | 1/2004 | Morales | 239/2.1 |
| 2004/0018055 | A1 * | 1/2004 | Clark et al. | 405/26 |

FOREIGN PATENT DOCUMENTS

JP 03-180609 * 8/1991

* cited by examiner

*Primary Examiner* — Tara Mayo-Pinnock
(74) *Attorney, Agent, or Firm* — Greenberg Traurig

(57) ABSTRACT

An apparatus and method for disrupting a hurricane are disclosed. The apparatus comprises a plurality of interconnected slabs. The slabs are connected using a series of cables. Cushions placed between the slabs prevent damage to the slabs during use. In practice, the interconnected slabs are towed to a position in the anticipated path of a hurricane. Once the interconnected slabs are positioned at a pre-determined location within the hurricane, they are maneuvered with the hurricane such their position remains generally fixed relative to the hurricane. The slabs form a partial barrier between the ocean and atmosphere thereby interfering with the critical mechanics, namely the rise of warm, moist air, of hurricane formation. The interconnected slabs are maneuvered with the hurricane for extended time periods such that they constantly disrupt the mechanics of hurricane formation.

11 Claims, 5 Drawing Sheets

HURRICANE TAMING APPARATUS AND METHOD OF USE

FIELD OF THE INVENTION

The embodiments of the present invention relate to an apparatus and method for taming a hurricane. The apparatus and method disrupt the mechanics which create and sustain or increase the strength of hurricanes.

BACKGROUND

In the United States between June 1 and November 30, hurricanes threaten the Eastern and Southern coastlines. In other parts of the world, similar storms are called typhoons and cyclones. Hurricanes wreak havoc when they make landfall. Hurricanes can kill thousands of people and cause billions of dollars of property damage when they hit heavily populated areas.

Hurricanes are defined by the following characteristics: tropical; cyclonic; and low-pressure systems. Hurricanes form in tropical regions where there is warm water, moist air and converging equatorial winds. Thunderstorms reach hurricane status in three stages. The three stages comprise the tropical depression, tropical storm and hurricane. It can take anywhere from hours to days for a thunderstorm to develop into a hurricane. While the formation of hurricanes is not completely understood, three events must occur for hurricanes to form. A continuing evaporation-condensation cycle of warm, humid ocean air, patterns of wind characterized by converging winds at the surface and strong, uniform-speed winds at higher altitudes and a difference in air pressure between the surface and high altitudes are the three events.

More specifically, warm, moist air from the ocean surface begins to rise rapidly. As the warm air rises, its water vapor condenses to form storm clouds and droplets of rain. The condensation releases heat called latent heat of condensation. The latent heat warms the cool air aloft, thereby causing it to rise. The rising air is replaced by more warm, humid air from the ocean below. This cycle continues, drawing additional warm, moist air into the developing storm and continuously moving heat from the surface to the atmosphere. The exchange of heat from the surface creates a pattern of wind that circulates around a center.

Converging winds are winds moving in directions that run into each other. Converging winds at the surface collide and push warm, moist air upward. The rising air reinforces the air that is already rising from the surface, so the circulation and wind speeds of the storm increase. In the meantime, strong winds blowing at uniform speeds at higher altitudes help to remove the rising hot air from the storm's center, maintaining a continual movement of warm air from the surface and keeping the storm organized. High-pressure air in the upper atmosphere over the storm's center also removes heat from the rising air, further driving the air cycle and the hurricane's growth. As high-pressure air is sucked into the low-pressure center of the storm, wind speeds increase.

Once formed, hurricanes comprise three main parts. The parts are the low-pressure eye, eye wall and rain bands. The eye wall surrounds the eye and comprises the fastest, most violent winds. The rain bands comprise bands of thunderstorms circulating outward from the eye that are part of the evaporation/condensation cycle that feeds the storm.

Because of the deaths and damage, attempts have been made to re-direct, stop and/or tame hurricanes. Unfortunately, the attempts have been unsuccessful on many fronts. More specifically, the attempts have not worked, have been extremely complex and have impacted the environment.

Therefore, a need exists for a system and method for taming a hurricane wherein said apparatus and method work, are not overly complex and do not impact the environment.

SUMMARY

Accordingly, a first embodiment of the present invention involves an apparatus comprising a large disruptive surface deemed a reticula net by the inventor. In one embodiment, the reticula net measures 1 mile×1 mile and is formed of interconnected floating slabs. The slabs are interconnected by cables such that they are individually spaced from one another. Cushions or shock absorbers are positioned between the slabs. In practice, the reticula net is positioned in the path of a hurricane. Positioning the reticula net is ideally accomplished as soon as possible. Once the hurricane reaches the position of the reticula net, the reticula net is maintained in a generally fixed position relative to the hurricane. In one embodiment, the position is such that a portion of the reticula net resides in the eye of the hurricane while the remaining portion resides between the ocean surface and the hurricane eye wall and rain bands. A series of tow ships are responsible for positioning and maintaining the reticula net. Consequently, the ships move the reticula net in unison with the movement of the hurricane so that the reticula net remains in a generally fixed position relative to the hurricane.

Ideally, the ships are unmanned and remotely controlled using satellites in conjunction with a Global Positioning System (GPS). Remotely controlling the ships may be accomplished by one or more operators stationed at any number of locations including the deck of a central ship, airplane or on land. It is also conceivable that the tow ships may be manned.

The reticula net is capable of being folded for transport and storage. A series of floating platforms permit the reticula net to be transported to the hurricane for deployment. Once deployed, the reticula net functions by interfering with the natural mechanics of the hurricane. By remaining in a fixed position with respect to the hurricane for an extended period of time, the reticula net constantly works to thwart the hurricane mechanics and reduce the strength of the hurricane. In optimum conditions, the reticula net reduces the hurricane to a tropical storm or an even less worrisome storm.

Other features, variations and embodiments will become evident from the detailed description, drawings and claims set forth below.

DETAILED DESCRIPTION

Figure 1:
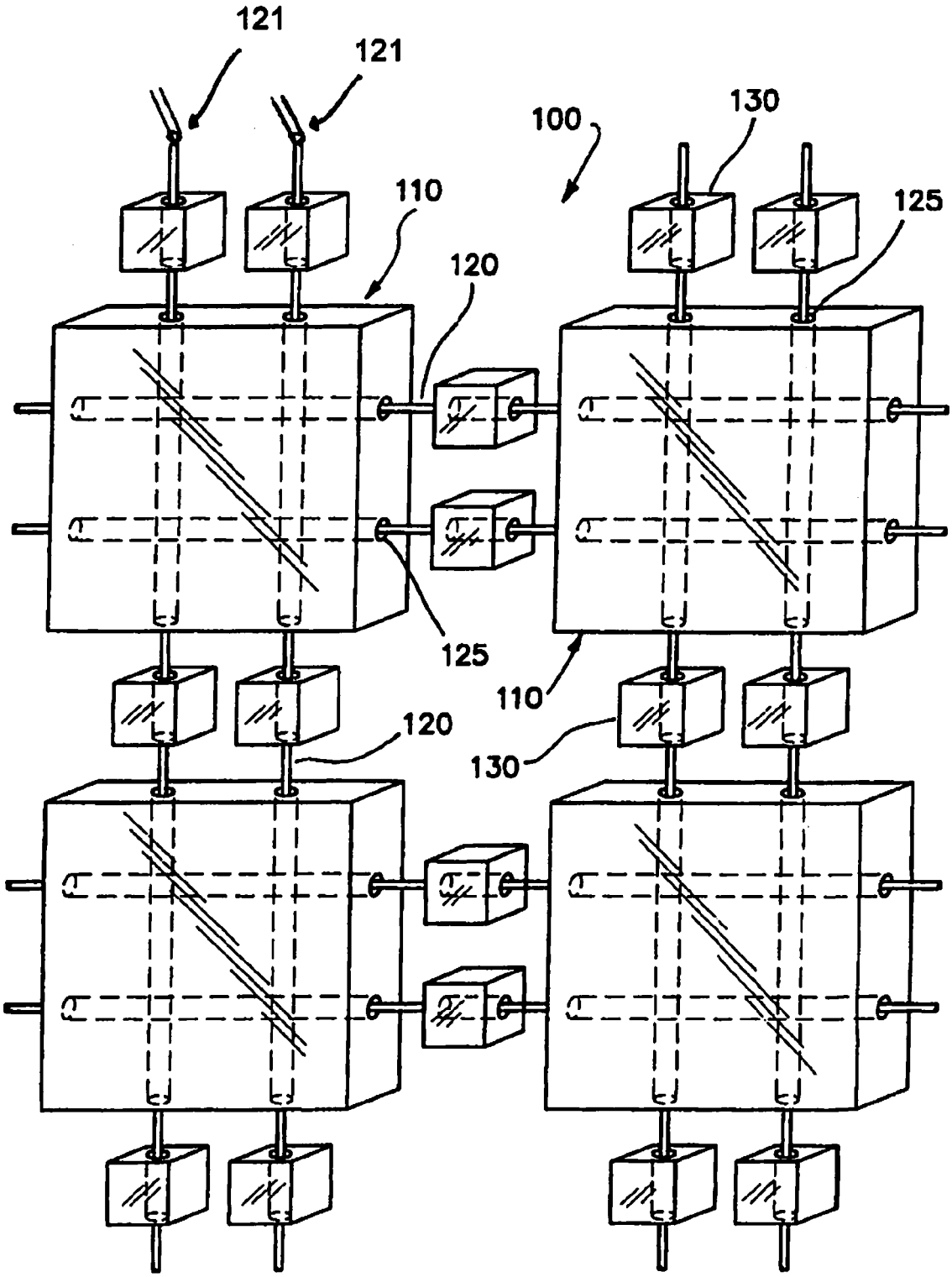
FIG. 1 shows a perspective view of a reticula net utilizing a first slab design.

Reference is now made to the figures wherein like parts are referred to by like numerals throughout. FIG. 1 shows a perspective view of reticula net of the first embodiment of the present invention generally referred to by reference numeral 100. The reticula net 100 comprises a plurality of slabs 110, cables 120 and cushions 130. The slabs 110 are fabricated such that they have a density less than water, namely the ocean's salt water. The slabs 110, cables 120 and cushions 130 may be fabricated of any suitable material or combination of materials, including rubber, plastics, steel and/or composites. FIG. 1 shows two cables 120 passing through cable channels 125 in each slab 110 and cushion 130. The cable channels 125 have a diameter approximately three or more times that of the cable passing through 120. This allows the slabs 110 and cushions 130 freedom of movement. As described below, the cables 120 are responsible for maintaining the structure of the reticula net 100 during hurricane conditions. To prevent damage to the slabs 110, ends of each cable channel 125 may be fitted with a rigid collar or elongated rigid tube to provide a reinforcing surface between the slab 110 and the cable 120. Also, the cushions 130 act to prevent the slabs 110 from contacting and damaging one another during use.

Figure 1A:
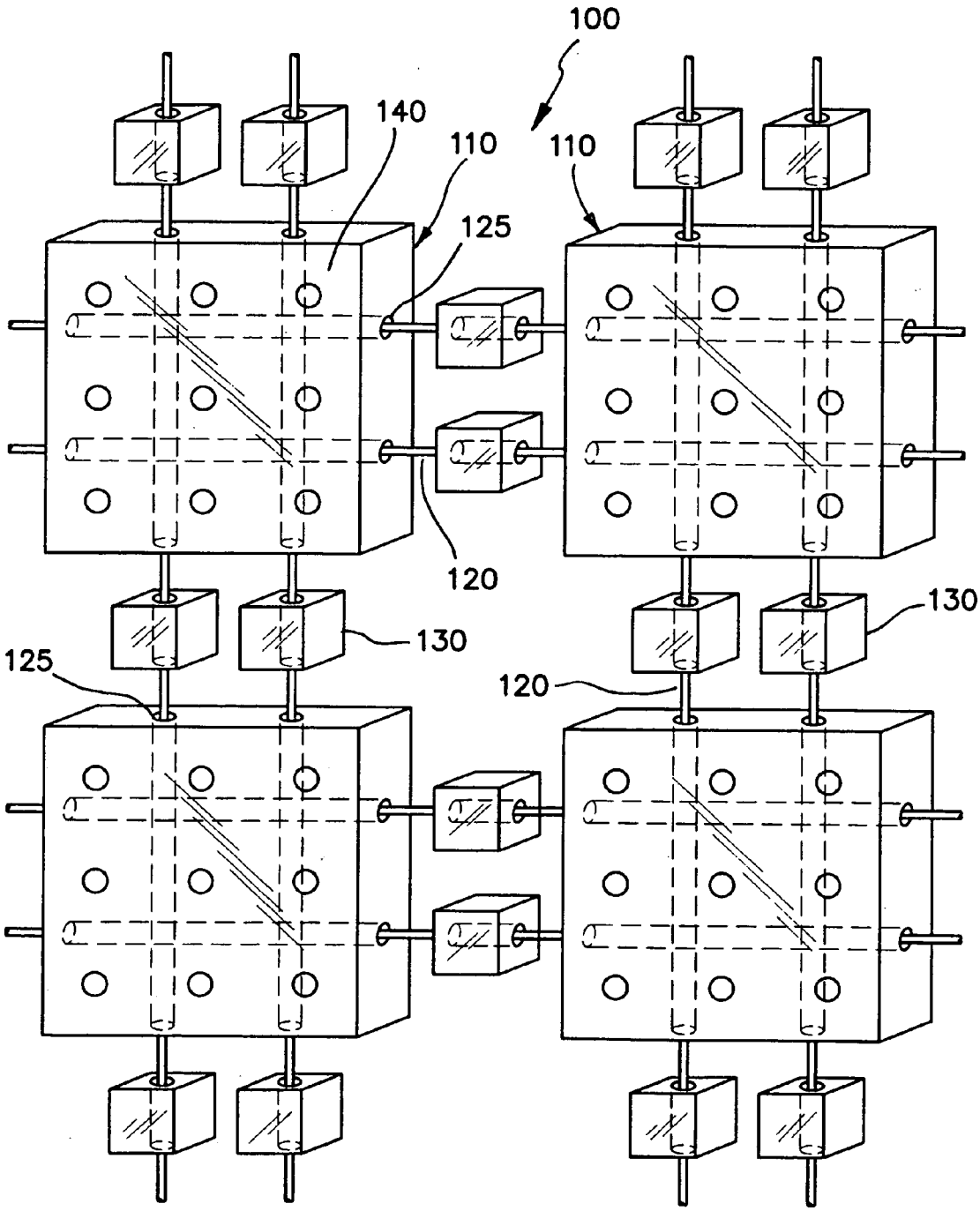
FIG. 1A shows a perspective view of the reticula net utilizing an alternative slab design.

In a first embodiment, the reticula net 100 is designed as a square having sides of one mile in length. The modular design of the reticula net 100 permits the size of the reticula net 100 to be adjusted quickly. The size of the hurricane is one factor dictating the size of the appropriate reticula net 100. In addition, the slabs 110 have square cross-sections with sides of fifteen feet in length and thicknesses of one feet. The cushions 130 are cubes with sides one feet in length. With this first embodiment, the slabs 110 are spaced along the cables 120 twenty inches apart and the cushions 130 are positioned therebetween with four inch gaps on either side. This configuration allows the slabs 110 and cushions 130 to have freedom of movement. The size, shape and/or number of slabs 110 and cushions 130 forming the reticula net 100 may be altered in an infinite number of ways. For example, the slabs 100 may be 10 feet in length and the cushions 130 may be cylinders rather than cubes. Indeed, the size of the reticula net 100 may be altered as necessary. For reasons disclosed below, as shown in FIG. 1A, the slabs 110 may include a series of holes 140 therethrough.

The reticula net 100 of the first embodiment is formed of 80% solid materials (i.e., slabs 110, cables 120 and cushions 130) and 20% open space. The percentages may change depending on the size, shape and number of slabs 110, cables 120 and cushions 130 in reference to the overall size of the reticula net 100.

In practice, the reticula net 100 is used to slow down the mechanics which create and sustain a hurricane. More specifically, the reticula net 100 must be positioned within a portion of the area defined by a hurricane. Then, the reticula net 100 is transported in unison with the hurricane. Thus, over an extended time period, the reticula net 100 is used to disrupt the mechanics (i.e., evaporation/condensation cycle) of the hurricane thereby preventing the strengthening of the hurricane such that the hurricane is weakened prior to landfall.

Figure 2:
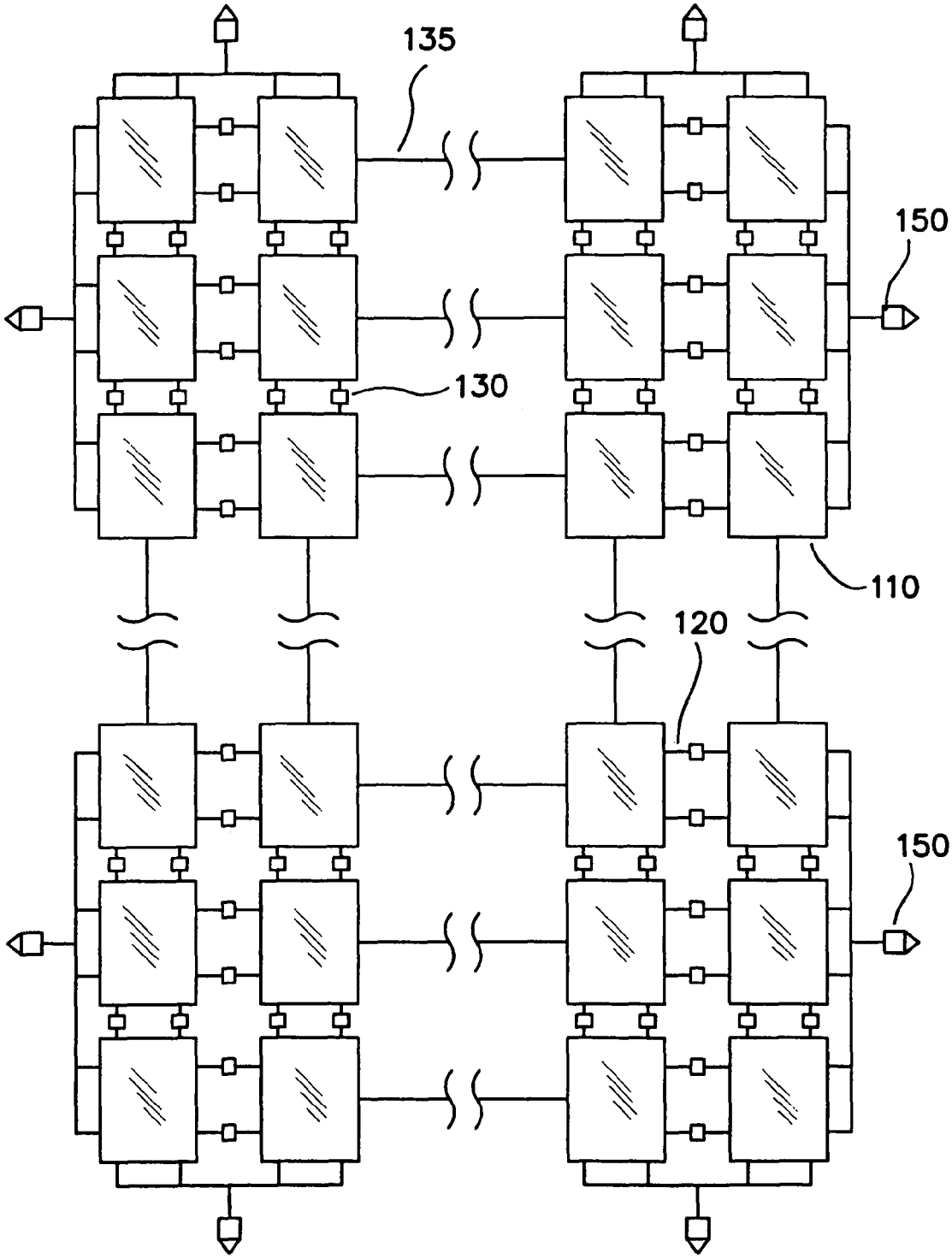
FIG. 2 shows an overhead view of the reticula net.
Figure 3:
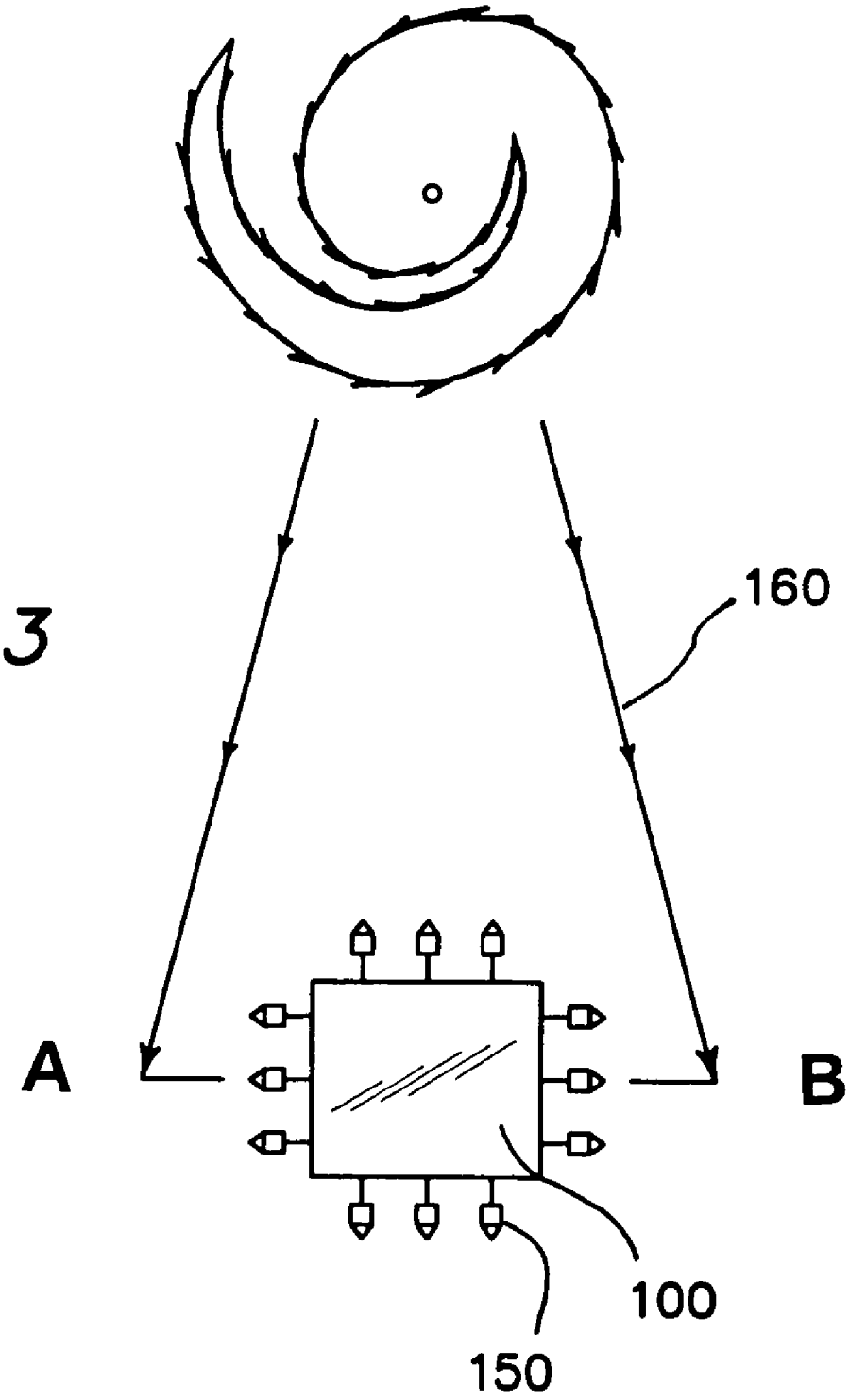
FIG. 3 shows an aerial view of the reticula net placed in the path of a hurricane.
Figure 4:
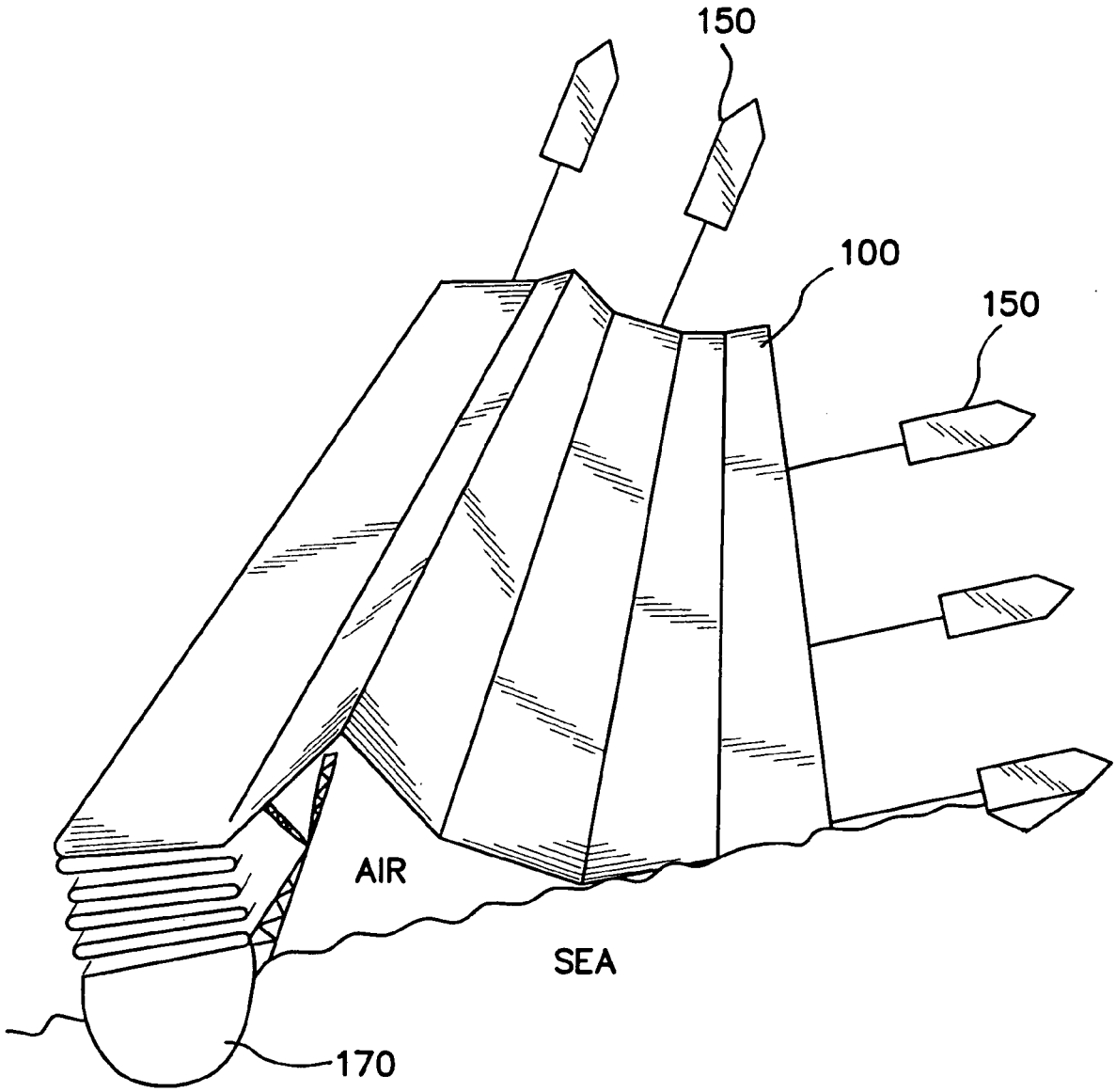
FIG. 4 shows a floating platform used to transport the reticula net into position.

Now referring to FIGS. 2, 3 and 4, a series of tow ships 150 are utilized to position the reticula net 100 in the path of a hurricane. The reticula net 100 of FIG. 2 utilizes rectangular shaped slabs 110. The broken lines 135 signify that the reticula net 100 may comprise any number of slabs 110 and cushions 130 as desired. Although the reticula net 100 is shown with identically spaced slabs 110, it is conceivable that the reticula net 100 may comprise individual sections having multiple slabs 110. For example, the reticula net 100 may include a plurality of sections each spaced from one another wherein each section comprises four slabs 110.

As weather technology has become more advanced, those skilled in weather patterns are now able to more accurately predict hurricanes and their path 160. With information regarding the hurricane's path in hand, the reticula net 100 may be positioned accordingly. As shown in FIG. 3 (not necessarily to scale), the reticula net 100 is positioned between points A and B which represent a probable range wherein the hurricane may pass. Ideally, the reticula net 100 is positioned as quickly as possible to maximize its effects. Preferably, the tow ships 150 are unmanned vehicles which are controlled with the use of GPS technology. Ideally, the tow ships 150 have a density similar to that of water such that they are unsinkable. Indeed, a majority of each tow ship 150 may be submerged to allow it to better handle the hurricane conditions it will encounter. Unmanned tow ships 150 ensure that lives are not lost implementing the system of the embodiments of the present invention. Preferably, the tow ships 150 are unmanned vehicles which are controlled with the use of GPS technology. Should the hurricane move off its anticipated path, the tow ships 150 maneuver the reticula net 100 accordingly.

GPS technology utilizes a system of twenty-seven satellites to track the position of cars, airplanes, ships and people. The system is based on a mathematical principle known as trilateration. The use of GPS for tracking ships is already well-known and ideal for the embodiments of the present invention. Since the position of the tow ships 150 is known, one or more operators may then maneuver the tow ships 150 accordingly. The operators may be stationed on a nearby ship, airplane or land mass. Using a control panel, including a display, the operators initially maneuver the tow ships 150 to a point in the anticipated path of the hurricane. The tow ships 150 may also be manned during the transport task since the deadly strength of the hurricane remains a safe distance away.

As shown in FIG. 4, transporting the reticula net 100 to the point in the anticipated path of the hurricane is accomplished using one or more floating platforms 170 which support the reticula net 100 during transport. The reticula net 100 is folded during transport and storage. To fold the reticula net 100, the cables 120 include a series of strategically spaced hinges 121, links or similar devices permitting certain cables 120 to bend satisfactorily. In a folded position, the reticula net 100 remains a large structure (e.g., 1 mile in length). Consequently, it is ideal that multiple floating platforms 170 be utilized to support the reticula net 100 during transport. Some or all of the tow ships 150 which maneuver the reticula net 100 within the hurricane may also be used to transport the reticula net 100 into position. Alternatively, the tow ships 150 may be placed on the floating platforms 170 and towed, along with the folded reticula net 100, by one or more large ships. Once in position, the reticula net 100 is unloaded from the floating platforms 170 which are then transported to a safe location. The cables 120 are connected to the appropriate tow ships 150. In the first embodiment, as shown in FIG. 2, tow ships 150 are positioned on all sides of the reticula net 100. This arrangement allows the reticula net 100 to be quickly maneuvered in any direction. Of course, the number and position of tow ships 150 may vary. For example, instead of four tow ships 150 on each side of the reticula net 100, one or more tow ships 150 may be connected at each corner of the reticula net 100.

Regardless of the number and position of tow ships 150, the one or more operators of the tow ships 150 seek to position the reticula net 100 within a specific area of the hurricane. In the first embodiment, the reticula net 100 is positioned such that 20% of the reticula net 100 resides in the eye of the hurricane and the remaining 80% of the reticula net 100 resides between the eye wall and rain bands forming the high energy zone of the hurricane. The operators seek to maintain the reticula net 100 in this fixed position relative to the hurricane for an extended period of time (e.g., 2-5 days). The final position of the reticula net 100 may be adjusted to accommodate the specific hurricane. For example, 10% of the reticula net 100 may be positioned in the eye and the remaining 90% may be placed between the eye wall and rain bands forming the high energy zone of the hurricane.

As the reticula net 100 remains in the generally fixed position, it prevents the critical evaporation-condensation cycle from freely occurring. In other words, the slabs 110 form a partial barrier between the ocean and atmosphere moving thereover to interfere with the rise of warm, moist air from the ocean to the atmosphere. In so doing, the hurricane does not receive the fuel it requires for growth and continued strength. The size of the subject hurricane may require the use of a large reticula net or multiple reticula nets. Over time, the lack of fuel, in the form of warm, moist air, weakens the hurricane. The weakening of the hurricane is analogous to the weakening hurricanes undergo when passing over land for an extended period of time. However, in this instance, the weakening occurs before the hurricane hits land. Ideally, once the reticula net 100 has been used to subdue the hurricane, after damage inspection and repairs, if necessary, the reticula net 100 can be used again.

Importantly, the reticula net 100 comprises a plurality of independent spaced slabs 110. With this arrangement, as the low pressure of the hurricane attempts to lift the reticula net 100 off the ocean's surface, the spaces between the slabs 110 allow the low pressure air to pass such that a majority of the reticula net 100 remains in contact with the ocean. In an alternative embodiment, the slabs 110 include the series of holes 140 for permitting low pressure air to pass through the slabs 110. A reticula net 100 made from a single continuous piece of material would likely be ripped to pieces as the low pressure air would have no other means of escape.

Advantageously, one or more measuring sensors (not shown) may be fixed to specific points of the reticula net 100. The measuring sensors collect and store hurricane data. The sensors may also transmit real time hurricane data (e.g., wind speeds and direction, temperature and pressure) to one or more remote locations. The data permits weather experts to better track the hurricane's movement and the effect of the reticula net 100 on the hurricane. In this manner, the position of the reticula net 100 relative to the hurricane may be adjusted to better disrupt the mechanics of the subject hurricane. Moreover, the collected data can be used to evaluate the efficiency of the reticula net 100 design such that it can be improved with successive uses.

In practice, multiple reticula nets 100 may be fabricated and stored in known hurricane locations, such as Florida, South Carolina and the Gulf Coast. Then, once a tropical storm or hurricane heading toward the coast has been identified, the proper agencies can take the appropriate actions to ready deployment of one or more reticula nets 100.

Although the invention has been described in detail with reference to several embodiments, additional variations and modifications exist within the scope and spirit of the invention as described and defined in the following claims.

I claim:

1. A method of disrupting formation of a hurricane comprising:

positioning a plurality of slabs within a hurricane such that the slabs form a partial barrier between an upper surface of the ocean and adjacent atmosphere, said slabs interconnected on a series of cables such that said slabs may translate independently at least partially along said cables during use within a hurricane, said slabs having a density less than ocean water, said slabs prevented from contacting one another by one or more members incorporated on said cables and positioned between adjacent slabs; and maintaining, over a period of time, the interconnected slabs in a generally fixed position relative to the hurricane.

2. The method of claim 1 further comprising initially positioning the plurality of interconnected slabs in an anticipated path of a hurricane.

3. The method of claim 1 further comprising providing a series of tow ships for positioning and maintaining the interconnected slabs.

4. The method of claim 3 further comprising remotely controlling the tow ships.

5. The method of claim 1 further comprising acquiring hurricane data from within the hurricane.

6. The method of claim 1 further comprising unfolding a system of interconnected slabs.

7. A method of disrupting formation of a hurricane comprising:

towing a plurality of interconnected slabs to a position in an anticipated path of a hurricane, said slabs interconnected on a series of cables such that said slabs may translate independently at least partially along said cables during use within a hurricane, said slabs having a density less than ocean water, said slabs prevented from contacting one another by one or more members incorporated on said cables and positioned between adjacent slabs;

if necessary, maneuvering the plurality of interconnected slabs in response to the path of the hurricane changing;

allowing the hurricane to pass over the plurality of interconnected slabs until the plurality of interconnected slabs are in a desired location within and relative to the hurricane; and maintaining, over a period of time, the interconnected slabs in the desired location within and relative to the hurricane.

8. The method of claim 7 further comprising unfolding the plurality of interconnected slabs once they are towed to the position in the anticipated path of the hurricane.

9. The method of claim 7 further comprising remotely controlling a plurality of unmanned tow ships for towing and maintaining the position of the interconnected slabs.

10. The method of claim 7 further comprising attaching one or more sensors to the plurality of interconnected slabs.

11. An apparatus for disrupting formation of a hurricane comprising:

a plurality of slabs interconnected on a series of cables such that said slabs may translate independently at least partially along said cables during use within a hurricane, said slabs having a density less than ocean water;

one or more members incorporated on said cables and positioned between adjacent slabs to prevent said slabs from contacting one another during translation; and means for positioning and maintaining said slabs between the ocean and atmosphere within the hurricane such that the slabs remain in a generally fixed position relative to the hurricane.

* * * * *